US008641389B2

(12) United States Patent
McKinney et al.

(10) Patent No.: US 8,641,389 B2
(45) Date of Patent: Feb. 4, 2014

(54) STACKED LABYRINTH CHAMBERS FOR USE WITH AN ELECTRICAL SUBMERSIBLE PUMP

(75) Inventors: Kelsey A. McKinney, Claremore, OK (US); Dan Merrill, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 257 days.

(21) Appl. No.: 13/303,493

(22) Filed: Nov. 23, 2011

(65) Prior Publication Data

US 2013/0129543 A1 May 23, 2013

(51) Int. Cl.
*F04B 35/04* (2006.01)
*F04B 17/00* (2006.01)

(52) U.S. Cl.
USPC ..... 417/414; 417/423.3

(58) Field of Classification Search
USPC ..... 417/423.3, 423.11, 414; 310/87; 277/336
See application file for complete search history.

(56) References Cited

U.S. PATENT DOCUMENTS

| | | | | |
|---|---|---|---|---|
| 3,502,919 | A * | 3/1970 | Drake et al. | 310/87 |
| 3,571,636 | A * | 3/1971 | Carle et al. | 310/87 |
| 3,671,786 | A * | 6/1972 | Jones | 310/87 |
| 4,462,765 | A * | 7/1984 | Rodkin et al. | 417/414 |
| 4,992,689 | A * | 2/1991 | Bookout | 310/87 |
| 5,367,214 | A * | 11/1994 | Turner, Jr. | 310/87 |
| 6,666,664 | B2 * | 12/2003 | Gross | 417/423.3 |
| 7,530,391 | B2 | 5/2009 | Hall et al. | |
| 7,665,975 | B2 * | 2/2010 | Parmeter et al. | 417/423.11 |
| 2011/0236233 | A1 * | 9/2011 | Merill | 417/410.1 |

* cited by examiner

*Primary Examiner* — Charles Freay
*Assistant Examiner* — Khurram Sajjad
(74) *Attorney, Agent, or Firm* — Bracewell & Giuliani LLP

(57) ABSTRACT

A labyrinth type seal section for use with an electrical submersible pump assembly having a guide tube with an axial bore to port wellbore fluid to a lower end of the seal section. Lubricating fluid fills substantially all of the seal section above an interface between the lubricating fluid and the wellbore fluid. The guide tube circumscribes a drive shaft that extends between a motor and a pump. The guide tube and shaft form an annulus filled with lubricating fluid that communicates to the well fluid and to the motor, so that pressure in the motor can be equalized to pressure of the ambient well fluid.

15 Claims, 2 Drawing Sheets

STACKED LABYRINTH CHAMBERS FOR USE WITH AN ELECTRICAL SUBMERSIBLE PUMP

BACKGROUND

1. Field of Invention

The present disclosure relates in general to submersible well pumps, and in particular to seal assemblies used in combination with the motors that drive submersible well pumps. More specifically, the present invention relates to stacked chambers that form an elongated labyrinth.

2. Description of Prior Art

A variety of fluid lifting systems are in use to pump fluids from a wellbore to surface handling and processing facilities. It is common to employ various types of downhole pumping systems to pump the subterranean formation fluids to surface collection equipment for transport to processing locations. One such conventional pumping system is a submersible pumping assembly which is immersed in the fluids in the wellbore. The submersible pumping assembly includes a pump and a motor to drive the pump to pressurize and pass the fluid through production tubing to a surface location. A typical electrical submersible pump assembly ("ESP") includes a submersible pump, an electric motor, and a seal section between the pump and the motor.

Generally, when an ESP is being inserted into a wellbore, pressure in the ESP is generally at about atmospheric. Wellbore pressure often significantly exceeds atmospheric pressure, thus unless the pressure inside the ESP is equalized to its surroundings, seals, especially in the motor section, can become compromised and leak. Because wellbore fluids are often electrically conductive, leaking wellbore fluid can create electrical shorts in the ESP and damage the motor. The seal section equalizes pressure in the ESP with the ambient pressure by communicating wellbore fluid pressure to the motor fluid. The communication though is limited to pressure, because as indicated above, wellbore fluid can damage the motor and/or introduce contaminates into the ESP.

SUMMARY OF THE INVENTION

Disclosed herein is an example of an electrical submersible pump (ESP) assembly and a seal section for use with an ESP. One example of an ESP includes a pump section having a pump, a motor section having a motor with a shaft that couples to the pump. The ESP also includes a seal section between the pump section and motor section. The seal section is made up of a housing, an annular guide tube circumscribing the shaft and that is in fluid communication with an annular space between the housing and guide tube. A port in a sidewall of the guide tube that is proximate the pump section provides the fluid communication between the housing and guide tube. A bore axially extends through a sidewall of the guide tube that is in communication with fluid ambient to the ESP assembly. An exit port is provided proximate the motor section so that the bore is in fluid communication with the annular space. When the ESP assembly is disposed in a wellbore having wellbore fluid, and the annular space is filled with a lubricating fluid, a labyrinth path is defined that extends from outside of the ESP assembly downward through the bore, upward through the annular space, and downward through an inner annulus between the guide tube and shaft to the motor section. Optionally, the ESP also includes an annular guide coaxially disposed within the housing and integrally formed with the guide tube. In this example, the ESP further includes a duct axially formed through the guide and in fluid communication with the bore and a bypass axially formed through the guide in fluid communication with the annular space. In an example embodiment, the seal section also includes a head mounted on an upper end of the housing having an internal cavity, a passage connected between the cavity and the bore, and a port formed through a sidewall of the head and between the cavity and ambient to the ESP assembly. In an example, wellbore fluid follows the labyrinth path to flow into a lower portion of the annular space to define an interface between the lubricating fluid and the wellbore fluid. Optionally, substantially all of the annular space above the interface is filled with lubricating fluid. The lubricating fluid may be disposed between the shaft and the guide tube.

Also provided herein is an example of a seal section for use with an electrical submersible pumping (ESP) system. In one embodiment the seal section includes a head section having a body, a cavity in the body in fluid communication ambient to the body through a port in a sidewall of the body. An annular upper housing is included that has an upper end connected to a lower end of the body along with an annular guide member coupled to a lower end of the upper housing. Further included is an annular lower housing having an upper end coupled to the guide member and an annular bottom guide member coupled to a lower end of the lower housing. The seal section also includes an upper guide tube having an upper end connected to the head section and a lower end connected to the guide member and a lower guide tube having an upper end connected to the guide member and a lower end connected to the bottom guide member. An upper bore is also provided that is axially formed through the upper guide tube having an upper end in fluid communication with the cavity and a lower end in fluid communication with a duct axially extending through the guide member. A lower bore is axially formed through the lower guide tube having an upper end in fluid communication with the duct and a lower end in fluid communication with an annular space between the lower guide tube and lower housing through an exit port in the guide tube proximate the bottom guide member. An axial bore extends through the upper and lower guide tubes, the guide member, the lower guide member, and head section, so that when annular spaces between the upper and lower guide tubes and upper and lower housings are filled with lubricating fluid, a motor is coupled to the lower housing with a shaft projecting through the bore, and the head section is disposed in a wellbore having wellbore fluid, wellbore fluid contacts the lubricating fluid and a pressure of the wellbore fluid is communicated to the motor. Optionally, an axial passage is included in the guide member for providing fluid communication between the annular spaces. A collar may optionally be included that is mounted on a lower end of the body and couples to the upper end of the upper guide tube and a passage extending from the cavity, through the body, and into fluid communication with the upper bore. In one example embodiment, the seal section further includes an inlet port formed through a sidewall of the upper guide tube proximate the head section. Optionally, wellbore fluid flows into a lower portion of the annular space between the lower guide tube and lower housing and defines an interface between the wellbore fluid and lubricating fluid. In one embodiment, substantially all of the annular space above the interface is filled with lubricating fluid. Alternatively, additional upper and lower bores are included that are spaced azimuthally apart in the upper and lower guide tubes. The seal section may also further include a torous shaped channel in the body for communicating wellbore fluid from the passage to the upper bores.

BRIEF DESCRIPTION OF DRAWINGS

Some of the features and benefits of the present invention having been stated, others will become apparent as the description proceeds when taken in conjunction with the accompanying drawings, in which.

Figure 1:
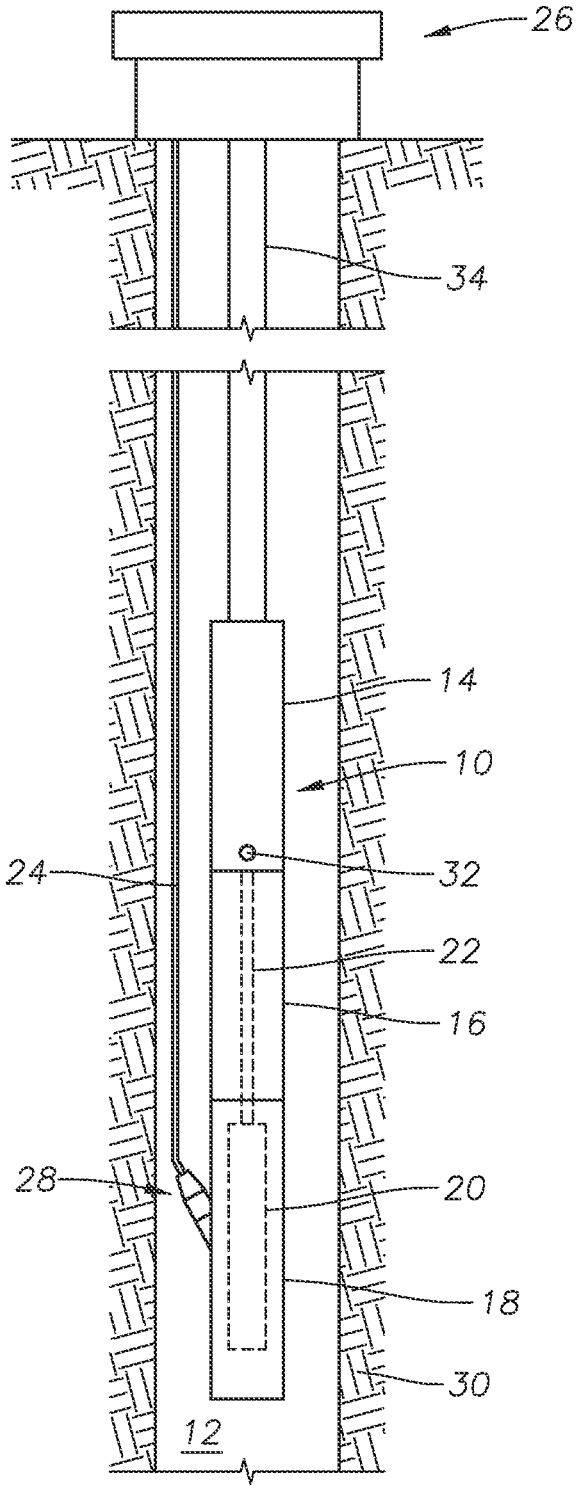
FIG. 1 is a side partial sectional view of an example embodiment of an electrical submersible pumping (ESP) system in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

An example embodiment of an electrical submersible pumping (ESP) system 10 is shown in a side view and disposed within a wellbore 12. The ESP 10 of FIG. 1 includes a pump section 14 on its upper end that has a seal section 16 depending on a lower end of the pump section 14, and a motor section 18 provided on a lower end of the seal section 16. A motor 20 is shown in a dashed outline within the motor section 18 having a drive shaft 22, also shown in dashed outline, that extends from the motor 20 to the pump section 14 for driving a pump (not shown) provided within the pump section 14. Power for driving the motor 20 is provided via a wireline 24 that is inserted into the wellbore 12 from a wellhead assembly 26 mounted on the surface at the opening of the wellbore 12. A connector 28 couples the wireline 24 to the ESP 10, where the connector 28 can be a pothead connector. Wellbore fluid is produced from a formation 30 surrounding the wellbore 12 and flows upward to a pump inlet 32 shown formed on an outer housing of the pump section 14. The pump pressurizes the wellbore fluid and discharges it into a string of production tubing 34 that couples on an upper end of the pump section 14. The production tubing 34 extends upward to the wellhead assembly 26 wherein fluid in the production tubing 34 can be directed for further processing or storage.

Figure 2:
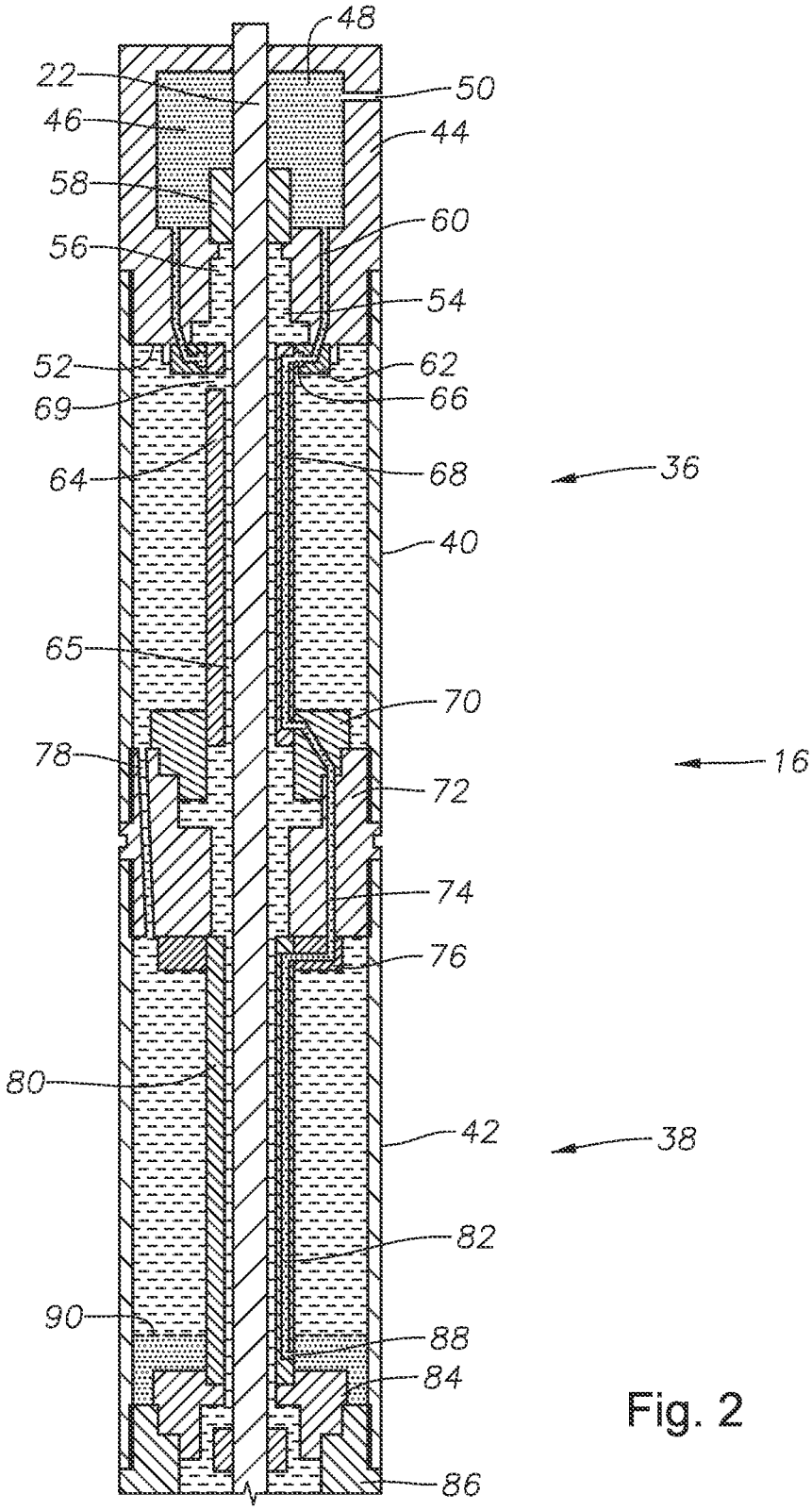
FIG. 2 is a side sectional view of an example embodiment of a seal section for use with the ESP of FIG. 1 in accordance with the present invention.

An example embodiment of the seal section 16 is shown in a side sectional view in FIG. 2. In the example of FIG. 2, the seal section 16 includes an upper section 36 having a substantially cylindrical outer surface and shown coupled to a substantially cylindrical lower section 38. Each of the upper and lower sections 36, 38 include an outer housing 40, 42. A head 44 is shown mounted on an upper end of the upper section 36. The example of the illustrated head 44 has a substantially cylindrical outer surface and an opening therein to define a cavity 46. Well fluid 48 is shown disposed within the cavity 46 that enters the cavity 46 via a port 50 that extends through a sidewall of the body of the head 44. Thus, when the ESP 10 (FIG. 1) is disposed in a fluid-filled wellbore 12, wellbore fluid 48 can flow into the cavity 46. Within the head 44 and below the cavity 46, the body of the head 44 projects radially inward to define a shoulder 52 on its lower end. The inner radius of the shoulder 52 defines an opening 54 within the shoulder 52. A dielectric fluid 56 is shown filling the space within the opening 54 and in the body of the housings 40, 42. A seal 58 circumscribes the shaft 22 of FIG. 2 and fills the space between the shaft 22 and inner radius of the opening 54 thereby separating wellbore fluid 48 from the dielectric fluid 56.

Passages 60 from the cavity 46 extend axially downward through the shoulder 52 and into an annular collar 62 shown coupled on a lower end of the shoulder 52. Coaxially mounted within the collar 62 is an annular guide tube 64 that circumscribes the shaft 22 and extends downward within the housing 40. A torous-shaped channel 66 is formed within the collar 62, and in the example of FIG. 2 provides fluid communication from the passages 60 and to a bore 68 formed axially within the upper guide tube 64. Although a single bore 68 is shown in the guide tube 64 of FIG. 2, multiple bores 68 may be provided therein and azimuthally-spaced apart from one another. The upper guide tube 64 is spaced radially outward from an outer surface of the shaft 22 to define an annulus 65 therebetween. The annulus 65 is in fluid communication with the annular space between the housing 40 and outer surface of the guide tube 64, where the fluid communication is via an inlet port 69 shown formed through a sidewall of the upper guide tube 64. In the example of FIG. 2, the inlet port 69 is proximate the collar 62.

A lower end of the guide tube 64 is shown mounted within an annular upper guide collar 70. The upper guide collar 70 is coaxially coupled in an upper section of an annular guide member 72. The upper guide member 72 is shown having a threaded portion on its outer surface, the housings 40, 42 of the upper and lower sections 36, 38 are shown mounted on opposite ends of the threaded portion. A duct 74 extends through the upper guide collar 70, the upper guide member 72, and to a lower guide collar 76. The lower guide collar 76 is shown as a generally annular member mounted to a lower end of the upper guide member 72. A bypass 78 is shown extending vertically through the upper guide member 72. An upper end of the bypass 78 is radially outward from the upper guide collar 70 and has a lower end that is radially outward from the lower guide collar 76. A lower guide tube 80 is shown mounted into a lower end of the lower guide collar 76 and having a bore 82 axially formed through a sidewall of the lower guide tube 80. Similar to the upper guide tube 64, multiple bores 82 may be provided azimuthally-spaced apart locations within the lower guide tube 80. In an example embodiment, the duct 74 provides fluid communication between the bore 68 and bore 82. Additionally, torous-shaped channels may be provided in both the upper guide collar 70 and lower guide collar 76 to accommodate the multiple and azimuthally-spaced apart bores 68, 72.

A lower end of the lower guide tube 80 is shown coupled to a bottom collar 84 that mounts in a lower end of the lower housing 42. The bottom collar 84 is an annular member and coupled to a bottom guide 86, shown having a structure similar to the upper guide member 72. An exit port 88 is shown formed through a sidewall of the guide tube 80 and providing fluid communication from the bore 82 into the annular space between the lower housing 42 and lower guide tube 80. In the example of FIG. 2, wellbore fluid 48 has exited the exit port 88 and is in contact with the dielectric fluid 56 to define an interface 90. Pressure in the wellbore fluid 48 communicates via the interface to the dielectric fluid 56, that in turn pressurizes the motor 20 (FIG. 1) to a pressure equal to a pressure ambient to the ESP 10.

In one example of operation of the ESP 10, dielectric fluid 56 is disposed in the annular spaces between the housings 40, 42 and upper and lower guide tubes 64, 80, in the annulus between the shaft 22 and upper and lower guide tubes 64, 80, and downward into the motor 20. The ESP 10 is lowered into the wellbore 12 and wellbore fluid 48 in the wellbore 12 enters into the cavity 46 via the port 50. As hydrostatic pressure in the wellbore 12 increases with increasing depth, the wellbore fluid 48 forces its way into the passage 60, bores 68, 82, out through the exit port 88, and into the lower end of the housing 42. Pressure of the wellbore fluid 48 is communicated to the dielectric fluid 56 across the interface 90. An advantage of the ESP 10 described herein is that the annular spaces between the housings 40, 42 and guide tubes 64, 80 is substantially filled with the dielectric fluid 56 above the interface 90. By increasing the amount of dielectric fluid 56 between the interface 90 and motor 20, more dielectric fluid 56 is between the motor 20 and wellbore fluid 48, thereby reducing the chances of the wellbore fluid 48 reaching and damaging the motor 20. Moreover, the sealing capacity of the seal section 16 is increased over that of other known embodiments.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An electrical submersible pump (ESP) assembly comprising:

a pump section having a pump;

a motor section having a motor that is coupled to the pump with a shaft; and a seal section between the pump section and the motor section comprising:

a housing;

an annular guide tube circumscribing the shaft in fluid communication with an annular space between the housing and the annular guide tube through a port in a sidewall of the annular guide tube disposed proximate the pump section;

a bore formed axially through a sidewall of the annular guide tube in communication with a fluid ambient to the ESP assembly and in fluid communication with the annular space through an exit port disposed proximate the motor section, so that when the ESP assembly is disposed in a wellbore having a wellbore fluid, and the annular space is filled with a lubricating fluid, a labyrinth path is defined that extends from outside of the ESP assembly downward through the bore, upward through the annular space, and downward through an inner annulus between the annular guide tube and the shaft to the motor section.

2. The ESP assembly of claim 1, further comprising an annular guide member coaxially disposed within the housing and integrally formed with the annular guide tube.

3. The ESP assembly of claim 2, further comprising a duct axially formed through the annular guide member and in fluid communication with the bore and a bypass axially formed through the annular guide member in fluid communication with the annular space.

4. The ESP assembly of claim 1, wherein the seal section further comprises a head mounted on an upper end of the housing having an internal cavity, a passage connected between the cavity and the bore, and a port formed through a sidewall of the head and between the cavity and ambient to the ESP assembly.

5. The ESP assembly of claim 1, wherein the wellbore fluid follows the labyrinth path to flow into a lower portion of the annular space to define an interface between the lubricating fluid and the wellbore fluid.

6. The ESP assembly of claim 5, wherein substantially all of the annular space above the interface is filled with lubricating fluid.

7. The ESP assembly of claim 1, wherein the lubricating fluid is disposed between the shaft and the annular guide tube.

8. A seal section for use with an electrical submersible pumping (ESP) system comprising:

a head section having a body, a cavity in the body in fluid communication ambient to an outer surface of the body through a port in a sidewall of the body;

an annular upper housing having an upper end connected to a lower end of the body;

an annular guide member coupled to a lower end of the annular upper housing;

an annular lower housing having an upper end coupled to the annular guide member;

an annular bottom guide member coupled to a lower end of the annular lower housing;

an upper guide tube having an upper end connected to the head section and a lower end connected to the annular guide member;

a lower guide tube having an upper end connected to the annular guide member and a lower end connected to the annular bottom guide member;

an upper bore axially formed through the upper guide tube having an upper end in fluid communication with the cavity and a lower end in fluid communication with a duct axially extending through the annular guide member;

a lower bore axially formed through the lower guide tube having an upper end in fluid communication with the duct and a lower end in fluid communication with an annular space between the lower guide tube and the annular lower housing through an exit port in the guide tube proximate the annular bottom guide member; and an axial bore extending through the upper and the lower guide tubes, the annular guide member, the annular bottom guide member, and the head section, so that when the annular spaces between the upper guide tube and the lower guide tube, the annular upper housing and the annular lower housings are filled with a lubricating fluid, a motor is coupled to the annular lower housing with a shaft projecting through the bore, and the head section is disposed in a wellbore having a wellbore fluid, the wellbore fluid contacts the lubricating fluid and a pressure of the wellbore fluid is communicated to the motor.

9. The seal section of claim 8, further comprising an axial passage in the annular guide member for providing fluid communication between the annular spaces.

10. The seal section of claim 8, further comprising a collar that is mounted on a lower end of the body and couples to the upper end of the upper guide tube and a passage extending from the cavity, through the body, and into fluid communication with the upper bore.

11. The seal section of claim 8, further comprising an inlet port formed through a sidewall of the upper guide tube proximate the head section.

12. The seal section of claim 8, wherein the wellbore fluid flows into a lower portion of the annular space between the lower guide tube and the annular lower housing and defines an interface between the wellbore fluid and the lubricating fluid.

13. The seal section of claim 12, wherein substantially all of the annular space above the interface is filled with the lubricating fluid.

14. The seal section of claim 8, further comprising a plurality of upper bores and a plurality of lower bores spaced azimuthally apart in the upper and lower guide tubes.

15. The seal section of claim 14, further comprising a torous shaped channel in the body for communicating the wellbore fluid from the passage to the plurality of upper bores.

* * * * *